United States Patent [19]

Hanlon et al.

[11] Patent Number: 4,473,378

[45] Date of Patent: Sep. 25, 1984

[54] DESENSITIZED CETANE IMPROVERS

[75] Inventors: John V. Hanlon, Baton Rouge, La.; James B. Hinkamp, Birmingham, Mich.

[73] Assignee: Ethyl Corporation, Richmond, Va.

[21] Appl. No.: 479,508

[22] Filed: Mar. 28, 1983

[51] Int. Cl.[3] ..... C10L 1/22
[52] U.S. Cl. ..... 44/57
[58] Field of Search ..... 44/57; 260/466, 467

[56] References Cited

U.S. PATENT DOCUMENTS 2,031,497 2/1936 Marvel ..... 44/57
2,065,588 12/1936 Howes ..... 44/57

FOREIGN PATENT DOCUMENTS 479969 2/1938 United Kingdom ..... 44/57
535401 4/1941 United Kingdom ..... 44/57
993623 6/1965 United Kingdom ..... 44/57

*Primary Examiner*—Mrs. Y. Harris-Smith
*Attorney, Agent, or Firm*—Donald L. Johnson; John F. Sieberth; Joseph D. Odenweller

[57] ABSTRACT

Compounds that are themselves effective cetane improvers in diesel fuel but are considered too explosion sensitive for safe handling can be rendered relatively nonsensitive by blending with $C_5$ to $C_{12}$ alkyl nitrates and the resulting blend is an effective cetane improver. An example is a 50—50 blend of 2-methyl-2-nitropropyl nitrate, a shock-sensitive compound, with isooctyl nitrate to give a relatively insensitive but very effective cetane improver.

9 Claims, No Drawings

DESENSITIZED CETANE IMPROVERS

BACKGROUND

Diesel engines operate by compression ignition. They have compression ratios in the range of 14:1 to 17:1 or higher and for that reason obtain more useful work from a given amount of fuel compared to a spark-ignited engine. Historically, diesel engines have been operated on a petroleum-derived liquid hydrocarbon fuel boiling in the range of about 300°–750° F. Recently, because of dwindling petroleum reserves, alcohol and alcohol-hydrocarbon blends have been studied for use as diesel fuel.

One major factor in diesel fuel quality is cetane number. Cetane number is related to ignition delay after the fuel is injected into the combustion chamber. If ignition delay is too long, the amount of fuel in the chamber increases and upon ignition results in a rough running engine and increased smoke. A short ignition delay results in smooth engine operation and decreases smoke. Commercial petroleum diesel fuels generally have a cetane number of about 40–55. Alcohols have a much lower cetane value and require the addition of a cetane improver for successful engine operation.

Through the years, many types of additives have been prepared to raise the cetane number of diesel fuel. These include peroxides, nitrites, nitrates, nitrocarbamates, and the like. Alkyl nitrates such as amyl nitrate, hexyl nitrate and mixed octyl nitrates have been used commercially with good results. Likewise certain cyclohexyl nitrates and alkoxyalkyl nitrates have been suggested as cetane improvers for diesel fuel (Olin et al U.S. Pat. No. 2,294,849).

Unfortunately some compounds that are very effective cetane improvers are also fairly sensitive explosives. Because of this they have not found commercial acceptance. Attempts have been made to desensitize some of these explosive compounds by blending with inert solvents. However, such blends are much less effective than the original compound and would require shipping and storing large amounts of cetane improver additive to provide the required cetane boost.

SUMMARY

It has now been discovered that normally explosion sensitive cetane improvers can be desensitized by blending with $C_5$–$C_{12}$ alkyl nitrates to provide a blend of cetane improvers that is both safe and which is a very effective cetane additive.

DESCRIPTION OF THE PREFERRED EMBODIMENT

A preferred embodiment of the invention is a desensitized cetane improver for use in diesel fuel, said cetane improver comprising a mixture of (a) at least one compound having a 50% explosion Drop Weight Rating of less than 20 Kg centimeters (cms) as measured by ASTM Method D-2540 and being capable of giving a greater cetane increase than an equal amount of any $C_5$ to $C_{12}$ alkyl nitrate and (b) a $C_5$ to $C_{12}$ alkyl nitrate in an amount sufficient to increase the ASTM D-2540 rating of the mixture to a value of at least 40 Kg centimeters (cms).

Explosive sensitivity is measured using the ASTM D-2540. This method is substantially the same as the Olin Matheson Drop Weight Test. It is routinely used to rate explosion sensitivity of liquid rocket monopropellants. In this test the test sample is placed in a small cavity formed by a steel cup. In the cup is placed an elastic ring and a steel diaphram on top of the elastic ring. A piston rests on the diaphram. The piston has a vent hole which is blocked by the steel diaphram. A weight is dropped on the piston. Explosion is indicated by puncture of the diaphram and a loud report. The sensitivity is the energy required to cause an explosion fifty percent of the time. This energy is the product of the drop weight and height of drop and is expressed as Kilogram centimeters (Kg cms). The lower this value is, the more explosion sensitive the test additive. A typical value for sensitive compounds such as nitroglycerin, ethyl nitrate and diethylene glycol dinitrate is 2 Kg - cms. Normal propyl nitrate rates about 15.5 Kg - cm.

Component (a) of the mixture will have a 50% explosion ASTM D-2540 rating of less than 20 Kg cm and also have a cetane improving effectiveness which is greater than that of an alkyl nitrate containing 5–12 carbon atoms. Thus whether a compound qualifies as a component (a) additive is readily determined by conducting an ASTM D-2540 Drop Weight Test and measuring its cetane improving effectiveness on a weight basis using a standard cetane engine compared to amyl nitrate, hexyl nitrates, heptyl nitrates, octyl nitrates, decyl nitrates or dodecyl nitrates.

Representative explosion sensitive compounds include the $C_{1-3}$ alkyl nitrates such as methyl nitrate, ethyl nitrate, n-propyl nitrate and is opropyl nitrate.

Organic polynitrates containing about 2–6 carbon atoms and 2–6 nitrate groups are useful such as glycol dinitrate, nitroglycerine, mannitol tetranitrate, trimethylolpropane trinitrate, penaerythritol tetranitrate, propylene glycol dinitrate, 1,4 butanediol dinitrate, and the like.

Many ether nitrates are sensitive explosives such as diethyleneglycol dinitrate, triethyleneglycol dinitrate, tetraethyleneglycol dinitrate, tetrahydro-3-furanol nitrate, 2-ethoxyethyl nitrate, 2-methoxyethyl nitrate, tetrahydro-3,4-furandiol dinitrate and the like.

Of the foregoing the more preferred ether nitrates are those having the formula $$R_1\text{-}(OR_2)_n\text{-}ONO_2$$

or $$O_2N\text{-}(OR_3)_m\text{-}ONO_2$$

wherein $R_1$ is a $C_{1-4}$ alkyl, $R_2$ and $R_3$ ar e $C_{2-4}$ divalent aliphatic hydrocarbon radicals and n is an integer from 1 to 4 and m is an integer from 2 to 4.

Organic nitro-nitrate compounds containing about 3–6 carbon atoms are likewise very effective cetane improving compounds that are also sensitive to explosion. These include compounds having the formula

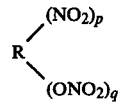

in which R is an aliphatic hydrocarbon group containing 3–6 carbon atoms and p and q are integers independently selected from 1 to 2.

Representative examples of these compounds are 2,2-dinitropropanol nitrate, 2-methyl-2-nitropropyl nitrate, 2-ethyl-2-nitro-1,3-propanediol dinitrate, 2-methyl-2-nitro-1,3-propanediol dinitrate, 2,2- dinitro-1,6-hexanediol dinitrate, 2,2-dinitrobutanol nitrate and the like.

Component (b) in the mixture is an alkyl nitrate containing 5–12 carbon atoms such as amyl nitrate, hexyl nitrates, heptyl nitrates, octyl nitrates, nonyl nitrates, decyl nitrates and dodecyl nitrates including all isomers and mixtures. More preferably component (b) is an alkyl nitrate containing 5–8 carbon atoms. The most preferred desensitizing alkyl nitrate is octyl nitrate in any of its isomeric forms.

The amount of component (b) in the blend should be an amount that reduces the explosion sensitivity of the mixture to an ASTM D-2540 rating above about 20 Kg cm. More preferably the amount of component (b) will be sufficient to increase the rating above about 40. Depending upon the degree of de-sensitizing required the amount of component (b) can range from 10–90 weight percent of the mixture. Generally the amount of (b) will be 25–75 weight percent. Excellent results have been achieved with 50—50 mixtures.

Representative examples of blends are given in the following table:

| Component A | Component B |
|---|---|
| 30% ethylene glycol dinitrate | 70% n-hexyl nitrate |
| 50% diethylene glycol dinitrate | 50% 2-ethyl hexyl nitrate |
| 10% 2-methoxyethyl nitrate | 90% n-decyl nitrate |
| 40% 2-ethoxyethyl nitrate | 60% 2-methyl pentyl nitrate |
| 60% 2-butoxyethyl nitrate | 40% n-pentyl nitrate |
| 10% nitroglycerine | 90% 2-ethyl decyl nitrate |
| 15% trimethylol propane trinitrate | 85% n-octyl nitrate |
| 50% tetrahydro-3-furanol nitrate | 50% 2-ethyl pentyl nitrate |
| 30% 2-nitro-2-methyl propylnitrate | 70% 2-ethyl hexyl nitrate |
| 35% 2,2-dinitro butyl nitrate | 65% 2-ethyl octyl nitrate |

It is indeed surprising that the addition of a compound which is itself an organic nitrate as well as an effective cetane improver to an otherwise explosive nitrate would have such a substantial effect on decreasing sensitivity.

ASTM D-2540 Drop Weight Tests were conducted to measure the de-sensitizing effect of the added organic nitrate. In these tests two otherwise very sensitive compounds were blended with an octyl nitrate mixture to decrease sensitivity. One sensitive compound was 2-nitro-2-methylpropyl nitrate and the other was 2-ethoxyethyl nitrate. Both of these compounds alone are more effective as a cetane improver than any $C_{5-12}$ alkyl nitrate but are quite prone to explode in the Drop Weight Test. The Drop Weight results are given in the following table.

| Additive | Drop Wt. Rating |
|---|---|
| 1. 2-nitro-2-methylpropyl nitrate | <10 Kg cm |
| 2. 2-nitro-2-methylpropyl nitrate + 27 wt % octyl nitrate | 27 Kg cm |
| 3. 2-nitro-2-methylpropyl nitrate + 50 wt % octyl nitrate | >40 Kg cm |
| 4. 2-ethoxyethyl nitrate | 6.6 Kg cm |
| 5. 2-ethoxyethyl nitrate + 50 wt % octyl nitrate | >40 Kg cm |

These results show that blending the explosion sensitive organic nitrates with a component (b) organic nitrate results in a substantially de-sensitized composition. The de-sensitizing effect provided by the invention is not necessarily applicable to thermal stability so, as with any organic nitrate, the mixtures should not be heated.

We claim:

1. A desensitized cetane improver for use in diesel fuel, said cetane improver comprising a mixture of (a) at least one compound having a 50% explosion Drop Weight Rating of less than 20 Kg centimeters as measured by ASTM Method D-2540 and being capable of given a greater cetane increase than an equal weight of any $C_5$ to $C_{12}$ alkyl nitrate and (b) a $C_5$ to $C_{12}$ alkyl nitrate in an amount sufficient to increase the ASTM D-2540 rating of the mixture to a value of at least 40 Kg cms.

2. A cetane improver of claim 1 wherein said alkyl nitrate is selected from the group consisting of pentyl nitrates, hexyl nitrates, heptyl nitrates, octyl nitrates, nonyl nitrates, decyl nitrates, and mixtures thereof.

3. A cetane improver of claim 2 wherein said compound having a 50% explosion ASTM D-2540 rating of less than 20 Kg centimeters is selected from the group consisting of $C_1$–$C_3$ alkyl nitrates, $C_2$–$C_6$ organic polynitrates, $C_3$–$C_8$ ether nitrates, $C_3$–$C_6$ organic nitronitrates, and mixtures thereof.

4. A cetane improver of claim 3 wherein said compound is an ether nitrate having the formula:

$$R_1\text{-}(OR_2)_n\text{-}ONO_2$$

or $$O_2N\text{-}(OR_3)_m\text{-}ONO_2$$

wherein $R_1$ is a $C_1$–$C_4$ alkyl and $R_2$ and $R_3$ are $C_2$–$C_4$ divalent aliphatic hydrocarbon groups, n is an integer from 1 to 4, and m is an integer from 2–4.

5. A cetane improver of claim 4 wherein said compound is a polyethylene glycol dinitrate containing 2–4 ethylene units.

6. A cetane improver of claim 3 wherein said compound is a $C_3$–$C_6$ organic nitro-nitrate having the formula:

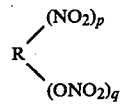

wherein R is an aliphatic hydrocarbon group containing 3–6 carbon atoms and p and q are integers independently selected from 1 and 2.

7. A cetane improver of claim 6 wherein said compound is 2-methyl-2-nitro-propyl nitrate.

8. A de-sensitized cetane improver consisting essentially of (a) about 25–75 weight percent of an organic nitro-nitrate containing 3–6 carbon atoms having an ASTM Method D-2540 Drop Weight Rating below about 20 Kg centimeters, and (b) about 75–25 weight percent of an alkyl nitrate containing 5–8 carbon atoms.

9. A de-sensitized cetane improver of claim 8 wherein said organic nitro-nitrate is 2-methyl-2-nitro-propyl nitrate.

* * * * *

UNITED STATES PATENT AND TRADEMARK OFFICE

CERTIFICATE OF CORRECTION

PATENT NO. : 4,473,378

DATED : September 25, 1984

INVENTOR(S) : John V. Hanlon, Et Al

It is certified that error appears in the above-identified patent and that said Letters Patent is hereby corrected as shown below:

Column 2, line 30, reads "is opropyl" and should read -- isopropyl --.

Column 2, line 50, reads "ar e" and should read -- are --.

Column 4, line 11, reads "given" and should read -- giving --.

Column 4, line 29, reads "$R_1 \leftarrow OR_2 \rightarrow ONO_2$" and should read -- $R_1 \leftarrow OR_2 \rightarrow_n ONO_2$ --.

Signed and Sealed this

Twenty-third Day of July 1985

[SEAL]

*Attest:*

DONALD J. QUIGG

*Attesting Officer* *Acting Commissioner of Patents and Trademarks*